US006283227B1

(12) United States Patent
Lerche et al.

(10) Patent No.: US 6,283,227 B1
(45) Date of Patent: Sep. 4, 2001

(54) DOWNHOLE ACTIVATION SYSTEM THAT ASSIGNS AND RETRIEVES IDENTIFIERS

(75) Inventors: Nolan C. Lerche, Stafford; David Merlau, Friendswood, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/179,507

(22) Filed: Oct. 27, 1998

(51) Int. Cl.[7] ..... E21B 43/116
(52) U.S. Cl. ..... 175/4.55; 102/215
(58) Field of Search ..... 175/4.54, 4.55; 166/297, 55.1, 65.1, 66; 361/249; 102/215, 217

(56) References Cited

U.S. PATENT DOCUMENTS

| | | | |
|---|---|---|---|
| 2,655,619 | 10/1953 | Neal . | |
| 3,181,463 | 5/1965 | Morgan et al. . | |
| 3,327,791 | 6/1967 | Harrigan, Jr. . | |
| 3,366,055 | 1/1968 | Hollander, Jr. . | |
| 3,517,758 | 6/1970 | Schuster . | |
| 3,640,224 | 2/1972 | Petrick et al. . | |
| 3,640,225 | 2/1972 | Carlson et al. . | |
| 3,978,791 | 9/1976 | Lemley et al. . | |
| 4,137,850 | 2/1979 | Donner . | |
| 4,208,966 | 6/1980 | Hart . | |
| 4,307,663 | 12/1981 | Stonestrom . | |
| 4,393,779 | 7/1983 | Brede et al. . | |
| 4,421,030 | 12/1983 | DeKoker . | |
| 4,422,381 | 12/1983 | Barrett . | |
| 4,441,427 | 4/1984 | Barrett . | |
| 4,471,697 | 9/1984 | McCormick et al. . | |
| 4,496,010 | 1/1985 | Chapman, III . | |
| 4,517,497 | 5/1985 | Malone . | |
| 4,527,636 | 7/1985 | Bordon . | |
| 4,592,280 | 6/1986 | Shores . | |
| 4,602,565 | 7/1986 | MacDonald et al. . | |
| 4,632,034 | 12/1986 | Colle, Jr. . | |
| 4,638,712 | 1/1987 | Chawla et al. . | |
| 4,662,281 | 5/1987 | Wilhelm et al. . | |
| 4,674,047 * | 6/1987 | Tyler et al. | 102/200 X |
| 4,700,629 | 10/1987 | Benson et al. . | |

(List continued on next page.)

FOREIGN PATENT DOCUMENTS

| | | |
|---|---|---|
| 0 029 671 | 9/1983 | (EP) . |
| 0 601 880 A2 | 6/1994 | (EP) . |
| 0604694 | 7/1994 | (EP) . |
| 677824 | 8/1952 | (GB) . |
| 693164 | 6/1953 | (GB) . |
| 2118282 A | 10/1983 | (GB) . |
| 2100395 B | 8/1984 | (GB) . |
| 2190730 A | 11/1987 | (GB) . |
| 2226872 A | 7/1990 | (GB) . |
| 2265209 A | 9/1993 | (GB) . |
| 2290855 A | 1/1996 | (GB) . |
| 0 386 860 B1 | 9/1990 | (WO) . |
| WO9623195 | 8/1996 | (WO) . |
| WO 98/38470 | 9/1998 | (WO) . |

OTHER PUBLICATIONS

"Performance Criteria for Small Slapper Detonators" Controller, Her Majesty's Stationery Office, London 1984.

(List continued on next page.)

*Primary Examiner*—David Bagnell
*Assistant Examiner*—Suuil Singh
(74) *Attorney, Agent, or Firm*—Trop Pruner & Hu P.C.

(57) ABSTRACT

A tool activating system includes multiple control units coupled to activate devices in a tool string positioned in a well. A processor is capable of communicating with the control units to send commands to the control units as well as to retrieve information (such as unique identifiers and status) of the control units. Selective activation of the control units may be performed based on the retrieved information. Further, defective control units or devices may be bypassed or skipped over.

17 Claims, 6 Drawing Sheets

U.S. PATENT DOCUMENTS

| | | | | |
|---|---|---|---|---|
| 4,708,060 | | 11/1987 | Bickes, Jr. et al. . | |
| 4,729,315 | | 3/1988 | Proffit et al. . | |
| 4,735,145 | | 4/1988 | Johnson et al. . | |
| 4,762,067 | | 8/1988 | Barker et al. . | |
| 4,777,878 | | 10/1988 | Johnson et al. . | |
| 4,788,913 | | 12/1988 | Stroud et al. . | |
| 4,831,933 | | 5/1989 | Nerheim et al. . | |
| 4,843,964 | | 7/1989 | Bickes, Jr. et al. . | |
| 4,884,506 | * | 12/1989 | Guerreri | 102/200 |
| 4,886,126 | | 12/1989 | Yates, Jr. . | |
| 4,944,225 | | 7/1990 | Barker . | |
| 5,014,622 | * | 5/1991 | Jullian | 102/312 |
| 5,088,413 | | 2/1992 | Huber et al. . | |
| 5,094,166 | | 3/1992 | Hendley, Jr. . | |
| 5,094,167 | | 3/1992 | Hendley, Jr. . | |
| 5,172,717 | | 12/1992 | Boyle et al. . | |
| 5,295,438 | | 3/1994 | Hill et al. . | |
| 5,347,929 | | 9/1994 | Lerche et al. . | |
| 5,413,045 | | 5/1995 | Miszewski . | |
| 5,505,134 | | 4/1996 | Brooks et al. . | |
| 5,520,114 | | 5/1996 | Guimard et al. . | |
| 5,539,636 | | 7/1996 | Marsh et al. . | |
| 5,706,892 | | 1/1998 | Jones et al. . | |
| 5,756,926 | | 5/1998 | Bonbrake et al. . | |

OTHER PUBLICATIONS

"New Developments in the Field of Firing Techniques" by K. Ziegler Propellants, Explosives, Pyrotechnics 12, 115–120 (1987).

"Application of Slapper Detonator Technology to the Design of Special Detonation Systems," by W. H. Meyers Proc. 12$^{th}$ Symposium on Explosives and Pyrotechnics, San Diego, California, Mar. 13–15, 1984, Detonation Systems Development, Los Alamos National Laboratory, pp. 4–5 through 4–19.

"CP DDT Detonators: II. Output Characterization," by M. L. Lieberman Sandia National Laboratories Report SAND 83–1893, Albuquerque, New Mexico, pp. 3–105 through 3–112, undated.

"A Fast, Low Resistance Switch for Small Slapper Detonators," by D. D. Richardson and D. A. Jones Department of Defense Materials Research Laboratories Report MRL–R–1030, Victoria, Australia, undated.

"The Effect of Switch Resistance on the Ringdown of a Slapper Detonator Fireset," by D. D. Richardson Department of Defense Materials Research Laboratories Report MRL–R–1004, Victoria, Australia, undated.

"Flyer Plate Motion and Its Deformation During Flight," by H. S. Yadav and N. K. Gupta Int. J. Impact Engng, vol. 7, No. 1, 1988, pp. 71–83.

"Mossbauer Study of Shock–Induced Effects in the Ordered Alloy $Fe_{50}Ni_{50}$ In Meteorites," By R. B. Scorzelli, I. S. Azevedo, J. Danon and Marc A. Meyers J. Phys. F: Met. Phys. 17 (1987), pp. 1993–1997.

"Effect of Shock–Stres Duration on the Residual Structure and Hardness of Nickel, Chromel, and Inconel," by L. E. Murr and Jong–Yuh Huang Materials Science and Engineering, 19 (1975), pp. 115–122.

Critical Energy Criterion for the Shock Initiation of Explosives by Projectile Impact, by H. R. James Propellants, Explosives, Pyrotechnics 13, (1988), pp. 35–41.

"High–Temperature–Stable Detonators," by R. H. Dinegar Proc. 12$^{th}$ Symposium on Explosives and Pyrotechnics, San Diego, California, Mar. 13–15, 1984, Los Alamos National Laboratory, pp. 4–1 through 4–4.

"Shock Initiation of PETN," by J. C. Cheng Monsanto Research Corporation, Miamisburg, Ohio, pp. 1–31 through 1–35, undated.

"Exploding Metallic Foils for Slapper, Fuse, and Hot Plasma Applications: Computational Predictions, Experimental Observations," by I. R. Lindemuth, J. H. Brownell, A. E. Greene, G. H. Nickel, T. A. Oliphant and D. L. Weiss, Thermonuclear Applications Group, Applied Theoretical Physics Division, and W. F. Hemsing and I. A. Garcia, Detonation Systems Group, Dynamic Testing Division, Los Alamos National Laboratory, Los Alamos, New Mexico, pp. 299–305, undated.

"A New Kind of Detonator—The Slapper," by J. R. Stroud Lawrence Livermore Laboratory, University of California, Livermore, California, pp. 22–1 through 22–6, undated.

"Pyrotechnic Ignition in Minislapper Devices," by D. Grief and D. Powell Awre, Aldermaston, Reading RG7 4PR, Berkshire, England, Controller, HMSO, London, 1981, pp. 43–1 through 43–10.

"Exploding Foils—The Production of Plane Shock Waves and the Acceleration of Thin Plates," by D. V. Keller & J. R. Penning, Jr. The Boeing Company, Seattle, Washington, pp. 263–277, undated.

"Acceleration of Thin Plates by Exploding Foil Techniques," by A. H. Guenther, D. C. Wunsch and T. D. Soapes Pulse Power Laboratory, Physics Division, Research Directorate Air Force Special Weapons Center, Kirtland Air Force Base, New Mexico, pp. 279–298, undated.

"A Low–Energy Flying Plate Detonator," by A. K. Jacobson Sandia National Laboratories Report, SAND 81–0487C, Albuquerque, New Mexico, 1981, pp. 49–1 through 49–20.

"Sequential Perforations in Boreholes," by H. Lechen ANTARES Datensysteme GmbH, Jan. 1998.

"A Simple Method for Estimating Well Productivity," by J. E. Brooks. SPE European Formation Damage Conference, The Hague, The Netherlands, Jun. 2–3, 1997.

"Unique Features of SCBs," by P. D. Wilcox and "SCB Explosive Studies" by R. W. Bickes, Jr. Initiating and Pyrotechnic Components Division 2515, undated.

* cited by examiner

DOWNHOLE ACTIVATION SYSTEM THAT ASSIGNS AND RETRIEVES IDENTIFIERS

BACKGROUND

The invention relates to addressable downhole activation systems.

To complete a well, one or more sets of perforations may be created downhole using perforating guns. Such perforations allow fluid from producing zones to flow into the wellbore for production to the surface. To create perforations in multiple reservoirs or in multiple sections of a reservoir, multi-gun strings are typically used. A multi-gun string may be lowered to a first position to fire a first gun or bank of guns, then moved to a second position to fire a second gun or bank of guns, and so forth.

Selectable switches are used to control the firing sequence of the guns in the string. Simple devices include dual diode switches for two-gun systems and concussion actuated mechanical switches or contacts for multi-gun systems. A concussion actuated mechanical switch is activated by the force from a detonation. Guns are sequentially armed starting from the lowest gun using the force of the detonation to set a switch to complete the circuit to the gun above and to break connection to the gun below. The switches are used to step through the guns or charges from the bottom up to select which gun or charge to fire. However, if a switch in the string is defective, then the remaining guns above the defective gun become unusable. In the worst case situation, a defective switch at the bottom of the multi-string gun would render the entire string unusable.

Other conventional perforating systems do not allow for the confirmation of the identity of which gun in the string has been selected. The identity of the selected gun is inferred from the number of cycles in the counting process. As a result, it is possible to fire the wrong gun unless precautions are followed, including a taking physical measurement, such as a voltage drop or amount of current to determine which gun has been selected before firing. This, however, adds complexity to the firing sequence. Furthermore, such precautionary measures are typically not reliable.

SUMMARY

In general, according to one embodiment, the invention features a system to activate devices in a tool string. The system includes control units that are adapted to communicate with a central controller. Switches are controllable by corresponding control units to enable activation of the devices.

Other features will become apparent from the following description and from the claims.

DETAILED DESCRIPTION

Figure 1:
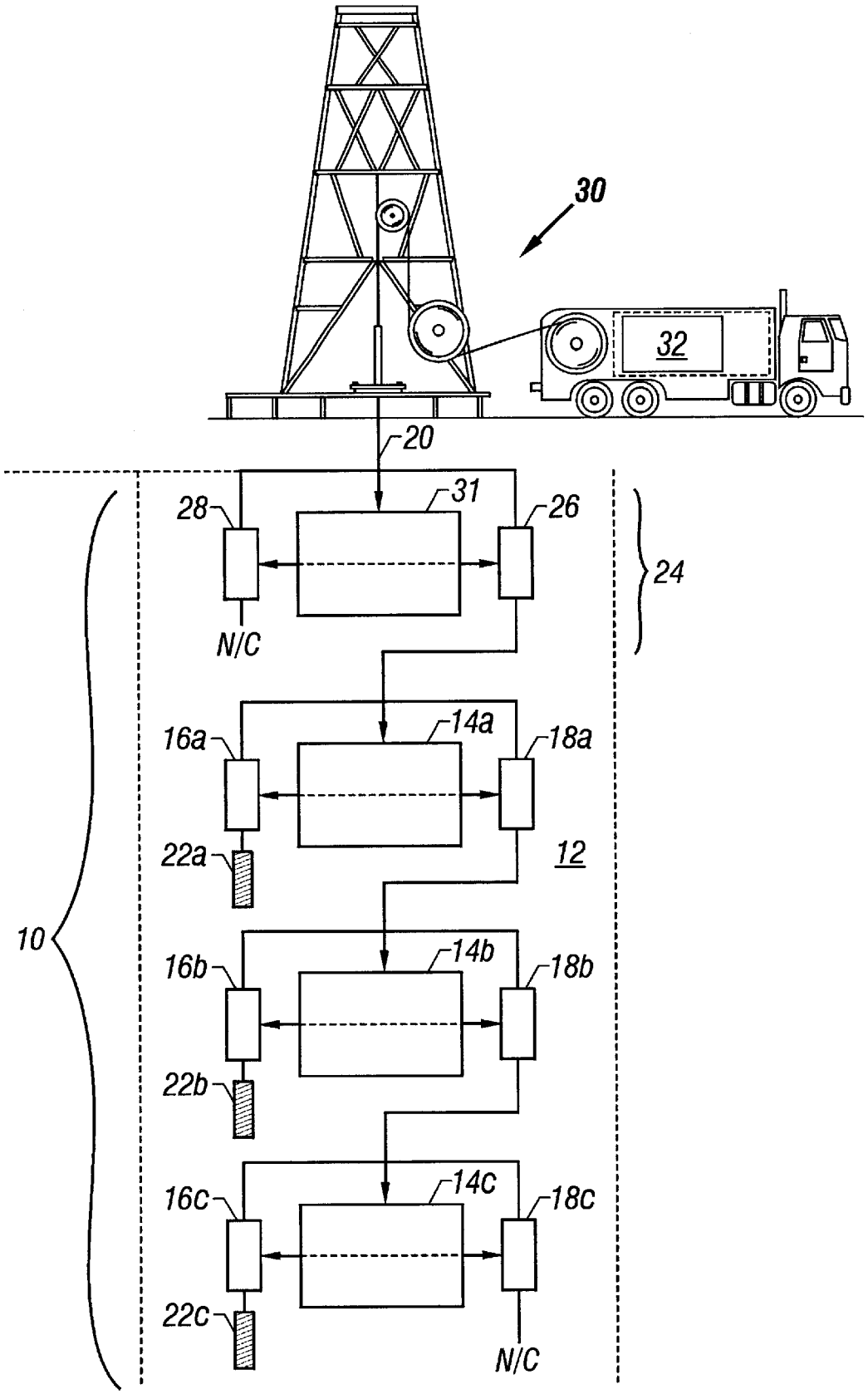
FIG. 1 is a diagram of a tool string incorporating an embodiment of the invention.

Referring to FIG. 1, a perforating system 10 according to an embodiment of the invention for use in a well 12 is illustrated. The perforating system 10 in the illustrated embodiment includes a multi-gun string having a control system that may include multiple control units 14A–14C that control activation of guns or charges in the string. Each control unit 14 may be coupled to switches 16 and 18 (illustrated as 16A–16C and 18A–18C). The cable switches 18A–18C are controllable by the control units 14A–14C, respectively, between on and off positions to enable or disable current flow through one or more electrical cables 20 (which may be located in a wireline or coiled tubing, for example) to successive control units. The switches 16A–16C are each coupled to a detonating device 22 (illustrated as 22A–22C) that may be found in a perforating gun for example. The detonating device may be a standard detonator, a capacitor discharge unit (CDU), or other initiator coupled to initiate a detonating cord to fire shaped charges or other explosive devices in the perforating gun. If activated to an on position, a switch 16 allows electrical current to flow to a coupled detonating device 22.

In the illustrated embodiment, the switch 18A controls current flow to the control unit 14B, and the switch 18B controls current flow to the control unit 14C. For added safety, a dummy detonator 24 may optionally be coupled at the top of the string. The dummy detonator 24 is first energized and set up before the guns or charges below may be detonated. The dummy detonator 24 includes a cable switch 26 that controls current flow to the first control unit 14A. The dummy detonator 24 also includes a control unit 31 as well as a dummy switch 28, which is not coupled to a detonator.

The one or more electrical cables 20 extend through a wireline, coiled tubing, or other carrier to surface equipment (generally indicated as 30), which may include a surface system 32, which may be a general-purpose or special-purpose computer, any other microprocessor- or microcontroller-based system, or any control device. The surface system 32 is configurable by tool activation software to issue commands to the downhole tool (e.g., perforating system 10) to set up and to selectively activate one or more of the control units 14.

Bi-directional electrical communication (by digital signals or series of tones, for example) between the surface system 32 and control units 14 downhole may occur over one or more of the electrical cables 20. The electrical communication according to one embodiment may be bi-directional so that information of the control units 14 may be monitored by the tool activation software in the surface system 32. The information, which may include the control units's identifiers, status, and auxiliary data or measurements, for example, is received by the system 32 to verify correct selection and status information. This may be particularly advantageous where an operator at the wellsite desires to confirm which of the devices downhole has been selected before actual activation (or detonation in the case of a perforating gun or explosive).

In other embodiments, a system such as a computer or other control device may be lowered downhole with the tool string. This system may be an interface through which a user may issue commands (e.g., by speech recognition or keyboard entries).

In one embodiment of the invention, each control unit 14 may be assigned an address by the tool activation software in the surface system 32 during system initialization. One advantage provided by the soft-addressing scheme is that the control units 14 do not need to be hard-coded with predetermined addresses. This reduces manufacturing complexity in that a generic control unit can be made. Another advantage of soft-addressing is that the control units may be assigned addresses on the fly to manipulate the order in which devices downhole are activated. In other embodiments, the control units 14 may be hard coded with pre-assigned addresses or precoded during assembly. Additional information may be coded into the control units, including the type of device, order number, run number, and other information.

The tool activation system according to embodiments of the invention also allows defective devices in the string to be bypassed or "skipped over." Thus, a defective device in a multi-device string (such as a gun string) would not render the remaining parts of the string inoperable.

Figure 2:
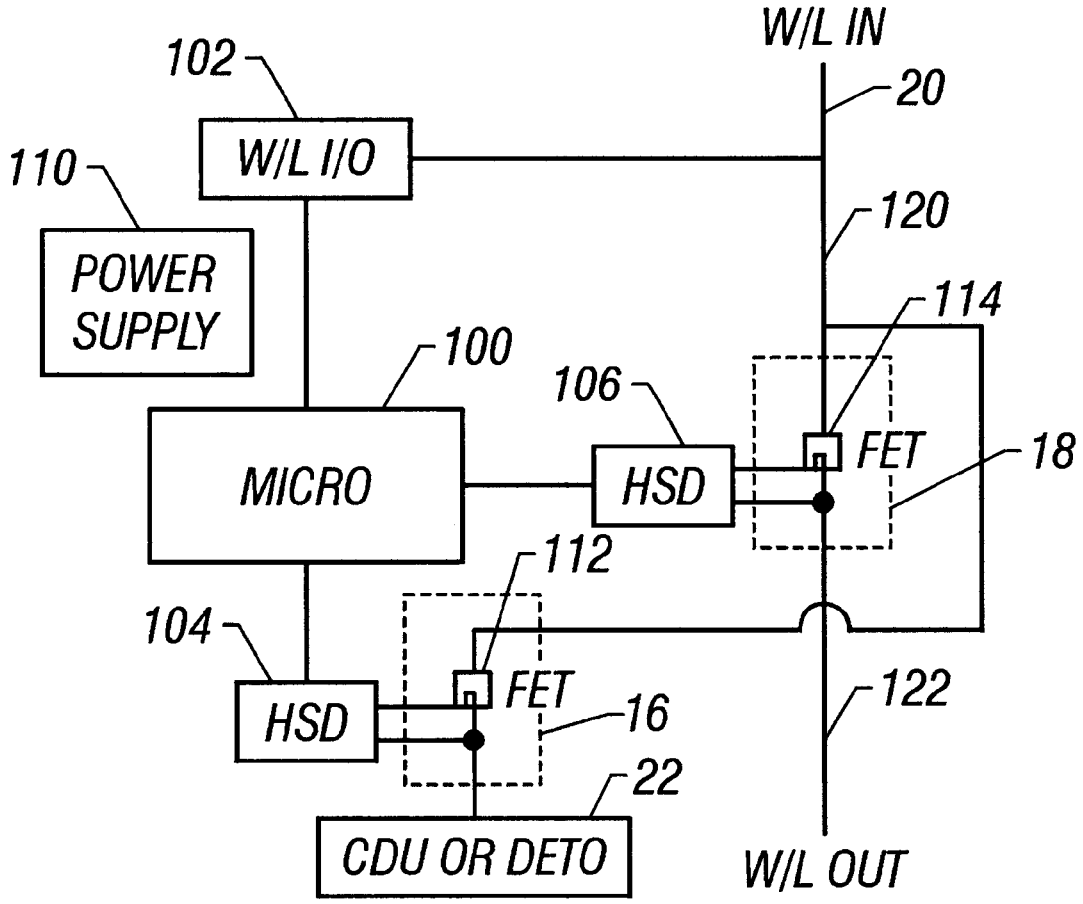
FIG. 2 is a block diagram of a control unit according to an embodiment used in the tool string of FIG. 1.

Referring to FIG. 2, a control unit 14 and switches 16 and 18 according to an embodiment are shown. A microcontroller 100 (which may by way of example be an 8051 microcontroller made by any one of several manufacturers) forms the processing core of the control unit 14, which communicates with other equipment (located downhole or at the surface) through an input/output (I/O) circuit 102 and the electrical cable 20. The components of the control unit 14 may be powered by a power supply 110. Other types of control devices may be substituted for the microcontroller 100, including microprocessors, application specific integrated circuits (ASICs), programmable gate arrays (PGAs), discrete devices, and the like. Although the description of some embodiments refer to microcontrollers, it is to be understood that the invention is not to be limited to such embodiments. In this application, the term control device may refer to a single integrated device or a plurality of devices. In addition, the control device may include firmware or software executable on the control device.

In one embodiment, the microcontroller 100 may control the switches 16 and 18 through high side drivers (HSDs) 104 and 106, respectively. HSDs are included in the embodiment of FIG. 2 since positive polarity voltages (typically in the hundreds of volts, for example) may be transmitted down the electrical cable 20. The microcontroller 100 in the illustrated embodiment may be biased between a voltage provided by the power supply 110 and ground voltage. The outputs of the microcontroller 100 may be at TTL levels. To activate the switches 16 and 18, the HSDs 104 and 106, respectively, convert TTL-level signals to high voltage signals (e.g., one or two threshold voltages above the electrical cable voltage) to turn on field effect transistors (FETs) 112 and 114. In further embodiments, HSDs may not be needed if negative polarity signals are transmitted down the electrical cable 20. Other types of switches may be used, including, for example, switches implemented with bipolar transistors and mechanical-type switches.

The microcontroller 100 is adapted to receive commands from the tool activation program in the surface system 32 so that it may selectively activate FETs 112 and 114 as indicated in the commands. When turned on, the transistor 114 couples two sections 120 and 122 of the electrical cable 20. Likewise, the transistor 112 couples the signal or signals in the upper section 120 of the cable 20 to the detonating device 22. In addition, each microcontroller 100 may be configured according to commands issued by the tool activation program Referring to FIG. 3, a flow diagram is shown of the tool activation program executable in the surface system 32. Before any unit in the string is activated, a sequence of set up and verification tasks are performed. The tool activation program first sends a wake event (at 202) down the electrical cable 20 to a control unit 14 downhole. In one embodiment, the top control unit is the first to receive this wake event. This process is iteratively performed until all control units 14 in the multi-tool string have been initialized and set up.

The wake event is first transmitted to a control unit I, where I is initially set to the value 1 to represent the top control unit. The program next interrogates (at 204) the control unit I to determine its address and status (including whether it has been assigned an address or not), positions of switches 16 and 18, and the status of the microcontroller 100. If the control unit I has not yet been assigned an address, the program assigns (at 206) a predetermined address to the control unit I. For example, the bottom unit may be assigned the lowest address while the top unit is assigned the highest address. Thus, if activation is performed by sequentially incrementing the address, the bottom unit is activated first followed by units coupled above.

Next, the program requests verification of the assigned address (at 208). Next, the program confirms the assigned address (at 210). If an incorrect address is transmitted back by the control unit I, then the process at 202–210 is repeated until a correct address assignment is performed. If after several tries the address assignment remains unsuccessful, the control unit I may be marked defective. If the address is confirmed, then a command is sent by the tool activation program down the electrical cable 20 to close the cable switch 18 associated with the control unit I. This couples the electrical cable 20 to the next control unit I+1 (if any). The program may next interrogate (at 214) control units 1–I (all units that have been so far configured) to determine their status. This may serve as a double-check to ensure proper initialization and set up of the control units.

The program then determines if the end of the multi-tool string has been reached (at 216). If not, the value of I is incremented (at 218), and the next control unit I is set up (202–216).

If the end of the multi-tool string has been reached (as determined at 216), then all tools in the string have been configured and activation power may be applied (at 220) to the next functional control unit in the activation sequence, which the first time through may be the bottom control unit in one example. The activation power is transmitted down the cable 20 and through the switch 16 to initiate the detonating device 22 to fire the attached perforating gun.

Figure 3:
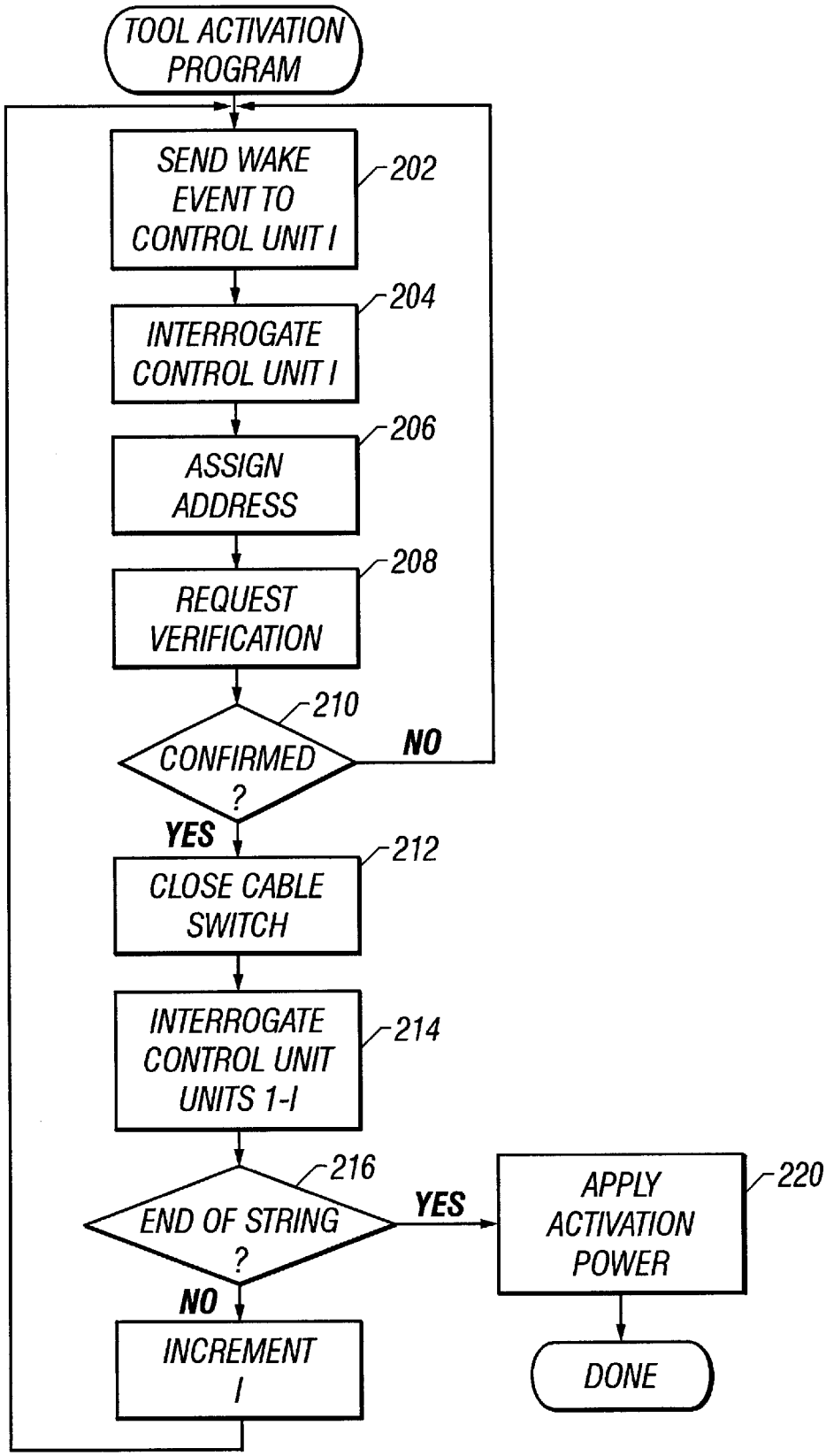
FIG. 3 is a flow diagram of software executed in a system to control activation of devices according to one embodiment.

The process is repeated to activate the other tools in the string. For example, if a control unit N has been activated to fire perforating gun N, then the control unit N–1 is classified as the last unit in the string. Power is removed from the electrical cable 20 and the tasks performed in FIG. 3 are then applied to the remaining control units (control units 1 to N–1, with control unit N–1 being considered the last control unit in the string). After sequencing through the tasks to set up the control units 1 to N–1, activation power may next be applied to control unit N–1. This process may be repeated for all tools in the string until the very top tool has been activated. In addition, if at any time interrogation by the program indicates that a control unit or tool is defective, that particular control unit and tool may be bypassed to activate the remaining control units. As a result, a defective tool does not render the entire multi-tool string inoperable.

Figure 4:
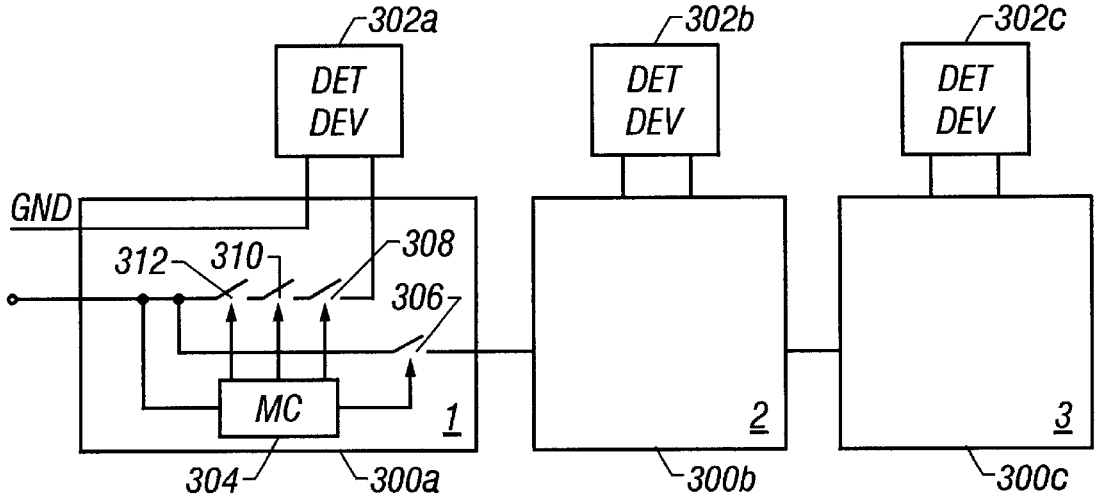
FIG. 4 is a block diagram of a control system according to another embodiment of the invention.

Referring to FIG. 4, a tool activation system according to another embodiment of the invention is illustrated. The system includes a series of addressable control units 300A–300C each coupled to corresponding tools 302A–302C (which in the illustrated embodiment are detonating devices forming parts of perforating guns). Commands are transmitted by the surface system 32 to select one of the control units 300A–300C. The command signals may be in the form of digital signals, a series of tones, or other types of communication, for example. The addressable control units 300A–300C prevent power from reaching the detonating devices 302A–302C prior to receipt of a specific command to arm the detonating devices. When addressed, each control unit responds with a specific identification and its status. The identification may include a manufacturer's serial number, an address, or some detailed information about the tool. Each control unit in the illustrated embodiment of FIG. 4 may include a microcontroller 304 (or another device or devices such as microprocessors, ASICs, PGAs, discrete devices, and the like) and switches 306, 308, 310 and 312. The electrical cable 20 essentially feeds into a series of three switches 312, 310 and 308, all controllable by the microcontroller 304. The switch 306 is a cable or cable switch that couples the electrical cable 20 above to the next control unit 300. The arming sequence of the control unit is as follows: first the microcontroller 304 activates a PREARM signal to enable the switch 312; next, the microcontroller 304 asserts a signal ARM1 to activate the switch 310; and finally, the microcontroller 304 activates a second arming signal ARM2 to activate the third switch 308. Only when all three signals are activated is shooting power provided to the detonating device 302 through the switches 306–310. Further, as added precaution, the three signals need to be activated above certain threshold levels.

Once the detonating device 302 is initiated and the attached perforating gun fired, the cable switch 306 may be closed by the microcontroller 304 in response to a surface command to allow selection of the next control unit 300. The cable switch 306 also can be used to bypass a defective control unit (such as a control unit that does not respond to a command).

Figure 5:
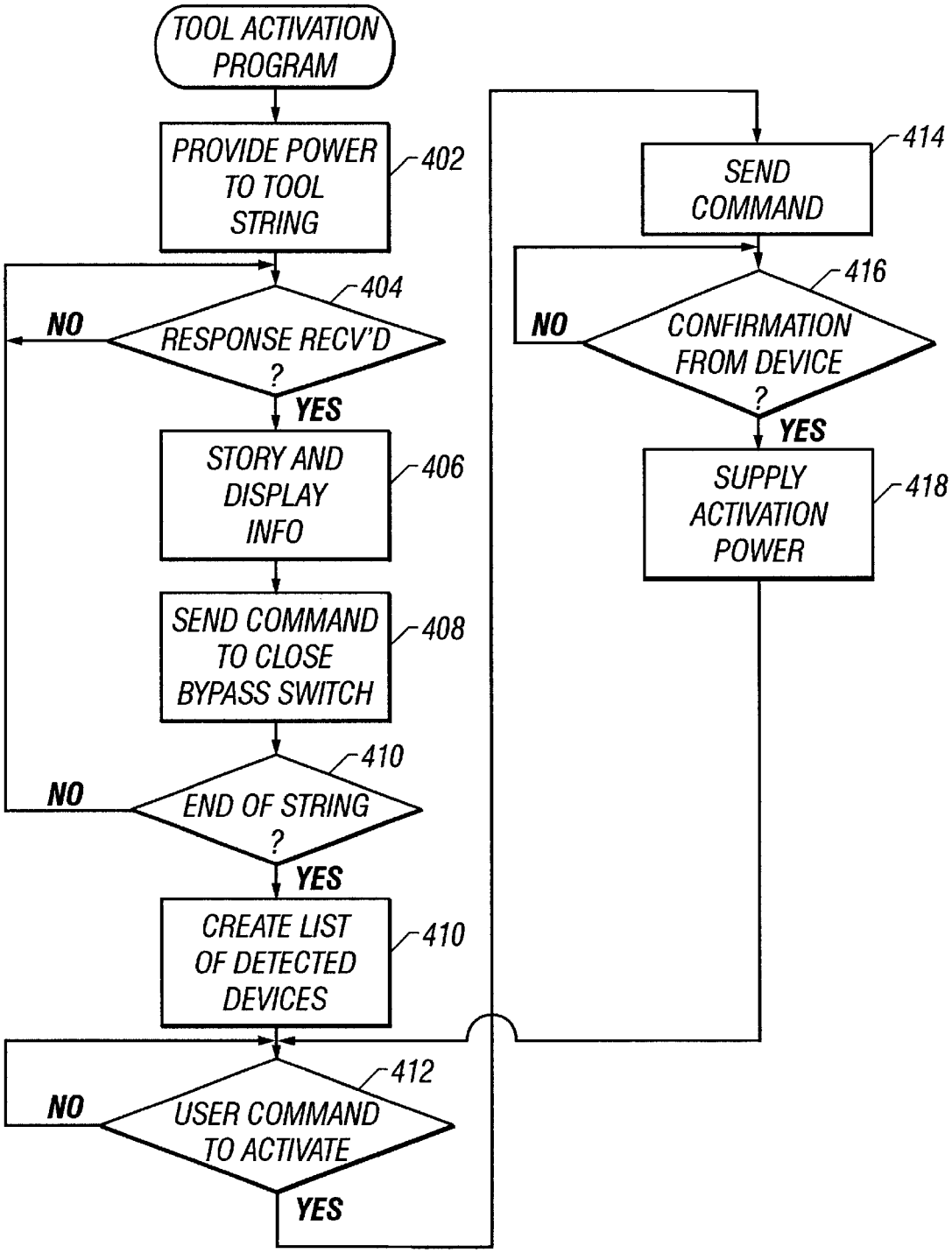
FIG. 5 is a flow diagram of software executed in a system to control activation of devices according to the other embodiment.

Referring to FIG. 5, the tool activation control sequence according to this other embodiment of the invention is illustrated. First, a low amount of power is provided by the surface system 32 to the tool string (at 402) to activate the control units in the tool string. The amount of current supplied is sufficiently low to ensure that the coupled detonating devices 302 do not detonate in the event of an electrical connection failure. When the initial current is received by the first control unit (300A), the microcontroller 304 starts an initialization sequence that maintains the PREARM and ARM signals deasserted. In addition, the microcontroller 304 sends data up the electrical cable to the surface system 32 that includes the microcontroller's address and a status of disarmed. Other information may also be included in the data transmitted to the surface.

The tool activation program in the surface system next determines if a response has been received (at 404) from a tool down below. If so, the received data may be stored and displayed to a user (at 406). Next, the program sends a command to couple to the next control unit in the sequence by closing the cable switch 306. In response, the microcontroller 304 activates the control signal to the cable switch 306 to close it. In one embodiment, the microcontroller 304 may be coupled to a timing device. If the microcontroller 304 does not respond to the bypass switch close command, the timing device would expire to activate the closing of the switch 306.

Next, the program waits for a time-out condition (at 410), which indicates the end of string has been reached. Control units are adapted to respond within a certain time period-if no response is received within the time period, then the surface system assumes that either no more devices or a defective device is coupled downstream. The process at 404–410 is repeated until the end of string is reached.

The surface system program next creates (at 411) a list of all detected devices downhole. As an added precaution, the user may compare this list with an expected list to determine if the string has been properly configured. The list of detected devices can also identify device timings as well as devices that are defective. Thus, the user may be made aware of such defective devices downhole, which are bypassed in the activation sequence.

To activate a particular tool downhole, the user would issue a command to the surface system. When the tool activation program receives this user command (at 412), it transmits an activate command or series of commands (which includes an address of the selected control unit) down to the tool string (at 414). At this point, because of the initialization process, all the cable switches 306 in all the control units are closed. Thus, each of the microcontrollers 304 is able to receive and decode the activate command. However, only the microcontroller 304 with a matching address will respond to the activate command. When the surface system program receives a confirmation from the selected device downhole (at 416), it checks the information transmitted with the confirmation to verify that the proper device has been selected. If so, the surface system program enables the supplying of activation power to the selected device (at 418). The tool activation program then waits for the next activation command.

The addresses of the control units may be preset during manufacture. Alternatively, jumpers or switches may be set in these control units to set their addresses. Another method includes the use of nonvolatile memory in the control units that may be programmed with the control unit's address any time after manufacture and before use.

Figure 6:
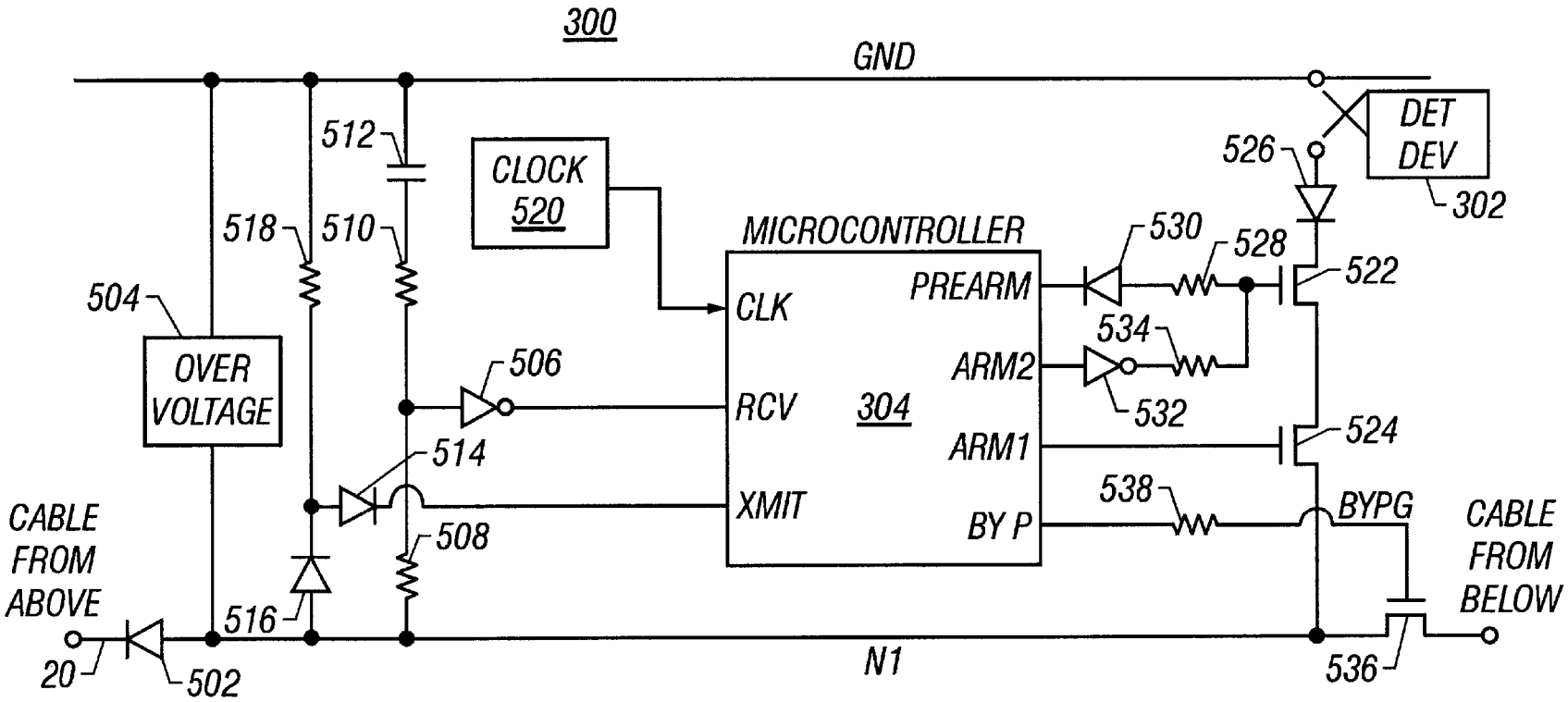
FIG. 6 is a schematic diagram of a control unit in the control system according to the other embodiment.

Referring to FIG. 6, some of the circuits of a control unit according to the alternative embodiment are illustrated in more detail. The illustrated embodiment is merely one example of how the control unit may be implemented—other implementations are possible. The electrical cable 20 is coupled from above through a diode 502 to a node N1 in the control unit 300. An over-voltage protection circuit 504 couples the internal node N1 to ground to protect circuitry from an over-voltage condition. The microcontroller 304 includes a receive input (RCV) to receive data over the cable 20 and a transmit output (XMIT) to transmit data to the cable 20. The RCV input is coupled to an output of an inverter 506, whose input is coupled to a resistor and capacitor network including resistors 508, 510 and a capacitor 512 all coupled between node N1 and the ground node. A signal coming down the cable 20 is received by the input of the inverter 506 and provided to the RCV input of the microcontroller 304. The XMIT output drives the cathode of a diode 514. A zener diode 516 is coupled between the anode of the diode 514 and node N1. On the other side, a resistor 518 is coupled between the anode of the diode 514 and ground.

A clock generator 520 provides the clock input to the microcontroller 304. The other outputs of the microcontroller 304 include signals PREARM, ARM1, and ARM2. Logically, as shown in FIG. 4, the signals PREARM, ARM1, and ARM2 control switches 312, 310 and 308, respectively, in each control unit. These switches 312, 310 and 308 may be implemented using serially coupled transistors 522 and 524, which couple the node NI to the detonating device 302 through a diode 526. The gate of the transistor 522 is coupled through a resistor 528 and a diode 530 to the signal PREARM of the microcontroller 304. The gate of the transistor 522 is also driven by the output of an inverter 532 through a resistor 534. The input of the inverter 532 is coupled to the signal ARM2 controlled by the microcontroller 304. The gate of the transistor 524 is driven by the output ARM1 from the microcontroller 304. Thus, the sequence for activating the detonating device 302 is as follows: the signal PREARM is driven high, the signal ARM1 is driven high, and the signal ARM2 is driven low. This turns both transistors 522 and 524 on to couple power from the electrical cable 20 through node N1 to the detonating device 302.

The cable switch 306 in one embodiment may be implemented with a transistor 536, which couples the internal node N1 of the control unit to the cable down below. The gate of the transistor 536 is coupled to a node BYPG that is the output of an RC network formed by a resistor 538 and a capacitor 539. The other side of the resistor 538 is coupled to a bypass output (BYP) of the microcontroller 304. In the illustrated embodiment, the timing device to bypass a defective microcontroller is formed by the resistor 538 and the capacitor 539. Thus, if the microcontroller 304 is not functioning for some reason, a pull-up resistor (not shown but coupled to the output pin BYP either internally or externally to the microcontroller) pulls the node BYPG to a "high" voltage after an amount of time determined by the RC constant defined by the resistor 538 and the capacitor 539. The node BYPG is coupled to the gate of a FET 536, which is part of the cable switch 306. When the node BYPG is pulled high after the time delay, the FET 536 is turned on, which allows communication to downstream devices on the electrical cable. This allows a defective microcontroller to be bypassed.

In the illustrated embodiment of FIG. 6, negative polarity signals are transmitted down the electrical cable 20. The microcontroller is biased between the voltage at node N1 and a high voltage provided by a power supply (not shown). To turn off the transistors 522, 524, and 536, the gates of those transistors are driven to the voltage of N1. To activate the transistors, their gates are driven to the power supply high voltage.

Other embodiments are within the scope of the following claims. For example, although the drawings illustrate a perforating system that may include multiple guns or explosives, other multi-device tool strings may incorporate the selective activation system described. For example, such tool strings may include coring tools.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed:

1. A system to activate devices in a tool string for use in a wellbore, comprising:

a central controller;

a cable extending into the wellbore;

control units adapted to communicate bi-directionally with the central controller over the cable;

switches controllable by corresponding control units to enable activation of the devices, the controller adapted to assign an identifier to each control unit and verify the assigned identifier prior to activation;

circuitry adapted to bypass a defective control unit or device during an activation sequence, wherein the circuitry includes a timing device operatively coupled to the control unit, the cable coupling the control units; and cable switches controllable by the central controller to isolate control units from the cable in an open state and to electrically couple control units to the cable in a closed state.

2. The system of claim 1, wherein the devices include perforating units.

3. The system of claim 1, wherein the central controller is adapted to transmit commands to selectively activate one or more of the control units.

4. The system of claim 1, wherein the central controller is adapted to transmit commands to configure each of the control units.

5. The system of claim 4, wherein the configuration includes assigning the corresponding identifier to each control unit.

6. The system of claim 1, wherein a status of each control unit is communicated to the central controller.

7. The system of claim 6, wherein the central controller is adapted to create a list of devices in the tool string and the status of each device.

8. The system of claim 7, wherein the status may indicate a device is defective.

9. An activation system for use with a tool string having multiple devices for use in a wellbore, comprising:

a processor;

control units coupled to control activation of the devices, each control unit assigned a unique identifier by the processor for selectivity of activation;

a link for extending into the wellbore to enable communication between the processor and the control units; and switches coupled to the link, each switch when open isolating portions of the link and when closed enabling communications between the portions.

10. The system of claim 9, wherein the identifier includes an address.

11. The system of claim 9, wherein each control unit is adapted to communicate the assigned identifier to the processor for identification.

12. The system of claim 9, wherein each control unit includes a microcontroller.

13. The system of claim 9, wherein the processor is adapted to bypass a defective perforating device or control unit.

14. Apparatus for activation of devices in a tool string in a well, comprising:

a processor;

controllers to control activation of the tool string devices;

a communications link between the processor and the controllers, the processor adapted to assign identifiers to the controllers and to verify the assigned identifiers by retrieving the assigned identifiers from the controllers;

timing devices operatively coupled to the controllers; and bypass switches coupled between successive controllers, each timing device timing out after a predetermined time period to activate a corresponding bypass switch if a corresponding controller is defective.

15. The apparatus of claim 14, wherein the communications link includes an electrical cable coupling the controllers to the processor.

16. The apparatus of claim 14, wherein the processor is adapted to selectively activate one of the devices.

17. The apparatus of claim 16, wherein the selective activation is based on a unique identifier assigned to each controller.

* * * * *